US008001741B2

(12) United States Patent
Duernberger

(10) Patent No.: US 8,001,741 B2
(45) Date of Patent: Aug. 23, 2011

(54) COVERING PANEL

(75) Inventor: Gerhard Duernberger, Strasswalchen (AT)

(73) Assignee: Kaindl Flooring GmbH, Wals (AU)

( * ) Notice: Subject to any disclaimer, the term of this patent is extended or adjusted under 35 U.S.C. 154(b) by 340 days.

(21) Appl. No.: 11/718,822

(22) PCT Filed: Nov. 9, 2005

(86) PCT No.: PCT/EP2005/011988

§ 371 (c)(1),
(2), (4) Date: May 8, 2007

(87) PCT Pub. No.: WO2006/050928

PCT Pub. Date: May 18, 2006

(65) Prior Publication Data

US 2008/0000185 A1 Jan. 3, 2008

(30) Foreign Application Priority Data

Nov. 10, 2004 (DE) ..... 10 2004 054 368

(51) Int. Cl.
*E04B 2/00* (2006.01)

(52) U.S. Cl. ..... 52/591.1; 52/582.1; 52/592.1

(58) Field of Classification Search ..... 52/591.1, 52/283–284, 245, 589.1, 592.1, 539
See application file for complete search history.

(56) References Cited

U.S. PATENT DOCUMENTS

| | | | | |
|---|---|---|---|---|
| 4,110,949 | A * | 9/1978 | Cambiuzzi et al. | 52/437 |
| 5,618,602 | A * | 4/1997 | Nelson | 428/60 |
| 6,006,486 | A | 12/1999 | Moriau et al. | |
| 6,421,970 | B1 * | 7/2002 | Martensson et al. | 52/282.1 |
| 6,438,919 | B1 | 8/2002 | Knauseder | |
| 6,505,452 | B1 * | 1/2003 | Hannig et al. | 52/582.1 |
| 6,682,254 | B1 * | 1/2004 | Olofsson et al. | 403/375 |
| 6,736,691 | B1 * | 5/2004 | Bach | 446/128 |
| 6,862,857 | B2 * | 3/2005 | Tychsen | 52/582.1 |
| 7,137,229 | B2 * | 11/2006 | Pervan | 52/313 |
| 7,188,456 | B2 * | 3/2007 | Knauseder | 52/592.1 |
| 2001/0024707 | A1 | 9/2001 | Andersson et al. | |
| 2003/0009971 | A1 * | 1/2003 | Palmberg | 52/578 |
| 2006/0260254 | A1 * | 11/2006 | Pervan | 52/592.1 |
| 2006/0272262 | A1 | 12/2006 | Pomberger | |

(Continued)

FOREIGN PATENT DOCUMENTS

CA 2 539 791 1/2005

(Continued)

OTHER PUBLICATIONS

International Preliminary Report on Patentability and its Written Opinion (PCT/ISA/237, in English and German).

(Continued)

*Primary Examiner* — Brian E Glessner
*Assistant Examiner* — Adam Barlow
(74) *Attorney, Agent, or Firm* — Greenblum & Bernstein, P.L.C.

(57) ABSTRACT

The invention relates to a cladding panel having at least two pairs of side edges lying substantially opposite one another. The cladding panel includes a coupling mechanism structured and arranged on at least one of the at least two pairs of side edges, and including a groove and a tongue extending along respective side edges of the at least one pair. A roughening formed on at least a section of at least one of the tongue and the groove.

20 Claims, 5 Drawing Sheets

U.S. PATENT DOCUMENTS

| | | | | |
|---|---|---|---|---|
| 2007/0065293 | A1 | 3/2007 | Hannig | |
| 2009/0199502 | A1 * | 8/2009 | Eisermann | 52/589.1 |

FOREIGN PATENT DOCUMENTS

| | | |
|---|---|---|
| DE | 297 24 428 | 5/2001 |
| DE | 100 34 409 | 1/2002 |
| DE | 202 19 023 | 3/2003 |
| DE | 103 29 686 | 2/2005 |
| DE | 101 41 791 | 12/2006 |
| EP | 1 024 234 | 8/2000 |
| EP | 1 026 341 | 8/2000 |
| FR | 1 483 017 | 6/1967 |
| JP | 09-317132 | 12/1997 |
| JP | 2000-145104 | 5/2000 |
| JP | 2001-504180 | 3/2001 |
| WO | 97/47834 | 12/1997 |
| WO | 98/22677 | 5/1998 |
| WO | 98/58142 | 12/1998 |
| WO | 03/074814 | 9/2003 |
| WO | 2004/079128 | 9/2004 |
| WO | 2005/003488 | 1/2005 |

OTHER PUBLICATIONS

International Search Report for International Application No. PCT/EP2005/011988.

An English language translation of the International Preliminary Report on Patentability and its Written Opinion.

English-language translation of Japanese Office Action for counterpart Japanese Patent Application 2007-540567.

* cited by examiner

COVERING PANEL

CROSS-REFERENCE TO RELATED APPLICATIONS

The present application is a U.S. National Stage of International Patent Application No. PCT/EP05/11988 filed Nov. 9, 2005, and claims priority under 35 U.S.C. §119 of German Patent Application No. 10 2004 054 368.2 filed Nov. 10, 2004.

BACKGROUND OF THE INVENTION

1. Field of the Invention

The invention relates to a cladding panel with two pairs of side edges lying opposite to one another and, in particular, a cladding panel having at least one pair of side edges provided with a coupling device embodied essentially in the form of a groove and a tongue and extending along the respective side edge.

2. Discussion of Background Information

Cladding panels of this type are generally known. Reference is made by way of example to EP 1 036 244 B1.

Generic panels are usually produced by essentially cuboid-shaped raw panels, i.e., raw panels, having side surfaces which are assigned to the side edges that run essentially orthogonally to the walking surface, being machined. This machining may be done, for example, by milling to form a coupling means on at least one pair of side edges, namely in the form of a groove in the area of one side surface and a tongue in the area of the other side surface. The purpose of this chip removal is thereby always to achieve the smoothest surfaces possible in order to slide two panels, which are connected to one another via a groove and a tongue, in the longitudinal direction of the respective side edge when laying the cladding panels.

One problem that generic cladding panels always have to deal with in practice is seasonal variations in relative humidity. In times of high relative humidity, the cladding panels expand because of swelling, whereas the cladding panels shrink during the heating period in winter because of low relative humidity. This swelling and shrinking causes the formation of cracks between panels abutting one another even if, as is customary with many types of cladding panels currently available on the market, the cladding panel's coupling mechanism is embodied with an integrated locking mechanism extendable in the longitudinal direction of the respective side edge of the cladding panel. These coupling mechanisms try to counteract the relative movement of the two panels in the direction of the panel plane, and orthogonally to the respective side edge. Cracks may also form from the effects of static and mechanical-dynamic stresses exerted on the floor, e.g., by heavy pieces of furniture or by walking on it. With rectangular cladding panels this crack formation problem occurs particularly at the short sides of the panels. The crack formation problem may also occur to a particular extent if the panels, as is customary today, are laid in a freely floating manner on the subfloor, i.e., are not connected to the subfloor by separate connecting means and are not glued to one another.

To prevent crack formation, EP 0 843 763 A1, EP 1 024 234 A1, and EP 1 026 341 A1, suggest a cladding panel which, when two panels are in a connected state, has a lower lip delimiting the groove of one panel and pressing against the tongue of the other panel with a prestressing force. This prestressing force is thereby produced by a permanent displacement of the lower lip from its resting position, when the panels are in an unconnected state. This permanent displacement causes a constant mechanical stress and a gradual fatigue of the panel material.

SUMMARY OF THE INVENTION

An aspect of the present invention is to provide a cladding panel of the type mentioned at the outset, which may be used to counteract the formation of cracks between two connected panels, without providing a prestressing force of this type.

This aspect is attained according to the invention by a cladding panel of the type mentioned at the outset, which has a roughening in at least one section of the groove's boundary surface and/or in at least one section of the tongue's boundary surface.

In connection with the present invention, "boundary surface" hereby refers to the surface extending from the side surface of the respective side edge, following the groove with a face normal facing into the groove, or following the tongue with a face normal facing away from the tongue and ending on the other side of the groove or of the tongue at the side surface of the side edge.

By providing the roughening according to the invention the friction between the groove of one panel and the tongue of the other panel is increased so that a relative displacement of the two interconnected panels in the longitudinal direction of the groove or tongue is made more difficult. This also counteracts the crack formation on the panel side running orthogonally to this longitudinal direction as well. Accordingly, if the cladding panel is a rectangular cladding panel with a short side and a long side, the crack formation can be counteracted at the short side of the panel in that at least one section of the boundary surface of groove and/or tongue includes a roughening at least on the long side. Naturally, providing a roughening in the area of the groove and/or the tongue on the short side of the panel also results in a reduction of the tendency of cracks to form on the long side of the panel.

With respect to achieving the highest possible friction, it is preferred that at least one section of the boundary surface with the roughening extends over essentially the entire length of the respective side edge, as well as in the circumferential direction of the boundary surface over essentially the entire circumference of the boundary surface. However, it can also be desirable, e.g., at least for reasons of manufacturing engineering, for at least one section of the boundary surface with the roughening to extend over merely a part of the length of the respective side edge and/or in the circumferential direction over merely a part of the boundary surface.

The friction between the boundary surface of the groove and the corresponding boundary surface of the tongue can be further increased in that, whenever at least one section of the groove's boundary surface and at least one section of the tongue's boundary surface are provided with a roughening, the roughening is provided at least in part on sections of the boundary surfaces of the groove and the tongue complementary to one another. Two sections of the boundary surfaces of a panel's groove or tongue are considered "complementary" within the meaning of this invention if the groove section provided with a roughening of the panel and the tongue section provided with a roughening of the other panel bear against one another in the connected state.

The roughening can be embodied in different ways: for example, at least one section provided with a roughening can be formed by a toothing. In order to achieve the highest possible friction between two connected panels, it is thereby suggested that the tooth sequence direction of the toothing run essentially in the longitudinal direction of the respective side edge, whereas the tooth extension direction runs essentially in the circumferential direction of the groove or the tongue. "Tooth sequence direction" thereby means the direction in which the teeth of the toothing follow one another which, in a conventional gear wheel is in the circumferential direction of the gear wheel. By contrast, the "tooth extension direction" means the direction in which the individual tooth extends which, in a conventional gear wheel with straight teeth is in the axial direction.

The toothing can be formed, e.g., by essentially chipless machining, for instance by indenting, serrating, or the like. Additionally, or alternatively, it is also possible to form the toothing by a chip-forming machining, e.g., by piercing, milling, or the like. With both alternatives for producing the toothing it is, however, advantageous to use a tool the rotational speed of which is adjusted to the feed rate of the panel such that its circumferential speed essentially corresponds to the feed rate of the panel.

In another embodiment, which can be used additionally or alternatively to the formation of the roughened section as a toothing, at least one section provided with a roughening can be formed by a plurality of wood fibers protruding from the surface of the respective section of the boundary surface. In order to cause the fibers to stand up, the surface can be treated with an agent, e.g., with a water-dilutable varnish (such as an unplasticized aqueous copolymer latex) which releases the fibers at least in part from their material compound, e.g., solid wood, MDF, or another wood material, and then raises and fixes the fibers.

According to another embodiment, which can also be used in addition to, or alternatively to, the above-discussed embodiments, at least one section provided with a roughening can be formed by a plurality of particles applied to the surface of the respective section of the boundary surface. These particles can be, e.g., particles of micronized polypropylene wax with a size between approximately 30 μm and 75 μm. Furthermore, these particles can be joined to the surface of the respective section of the boundary surface by means of an adhesion promoter, e.g., a water-dilutable varnish (such as an unplasticized aqueous copolymer latex).

As indicated above, at least the core of the panel can be formed of a wood material, e.g., solid wood, a chipboard, an MDF board, or the like. However, it is also possible to apply the principles according to the invention to other materials, e.g., compact laminate, plastic, or the like.

As already mentioned above, the coupling mechanism can be embodied with an integrated locking mechanism extending in the longitudinal direction of the respective side edge. These locking mechanisms can be formed from a core material, e.g., in one piece. However, it is also conceivable to embody the locking mechanism and/or the coupling mechanism in or at a coupling unit connected to the panel's core. This coupling unit can be connected to the panel's core such that, e.g., a suitable material such as plastic, a wood extrudate, or the like, is injected into a prepared indentation in the side surface of the panel and is subsequently machined in a material-removing manner to form the coupling mechanism and/or the locking mechanism. But, as an alternative, it is also possible to insert a prefabricated part with a coupling mechanism and/or a locking mechanism prefabricated thereon into the prepared indentation.

The invention can be used in a particularly advantageous manner if the cladding panel is a flooring panel, and particularly if the flooring panel is designated to be laid in a floating manner and/or without the use of adhesive to connect adjacent panels.

BRIEF DESCRIPTION OF THE DRAWINGS

The invention is explained in more detail below by means of exemplary embodiments on the basis of the enclosed drawings. They show.

DETAILED DESCRIPTION OF THE PRESENT INVENTION

Figure 2:
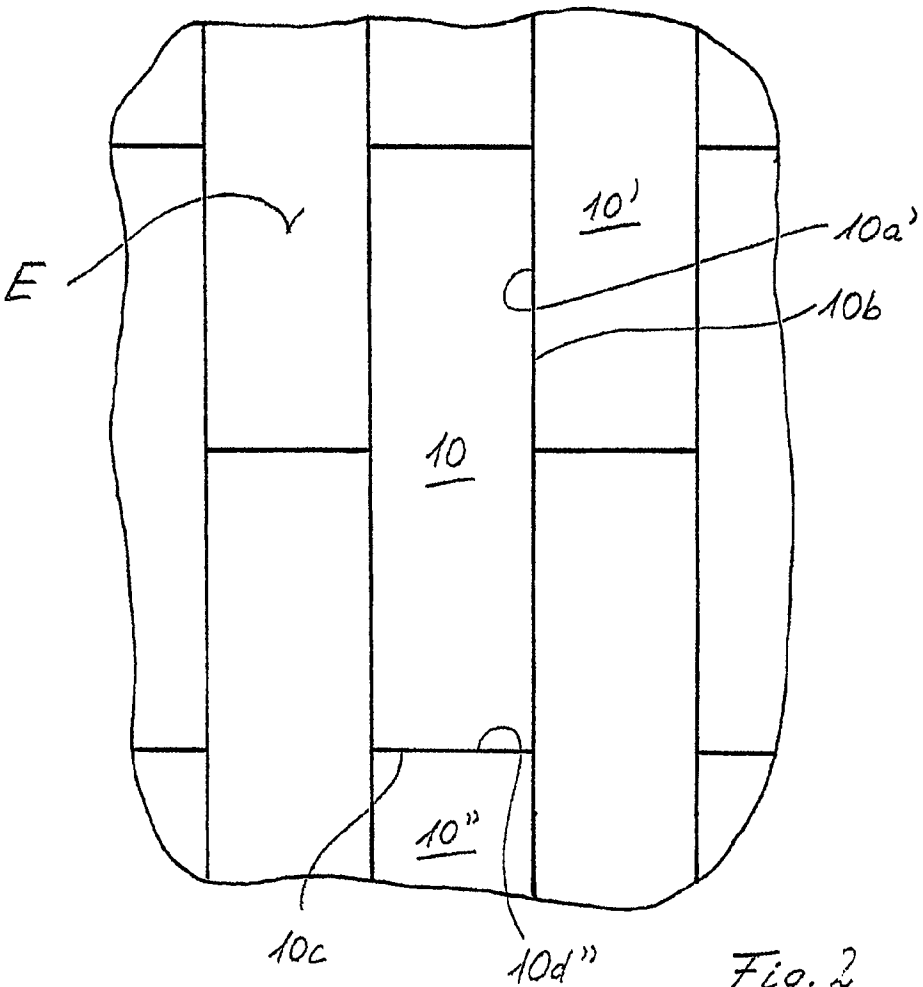
FIG. 2 A partial top view of a covering layer formed by a plurality of cladding panels of this type.
Figure 1:
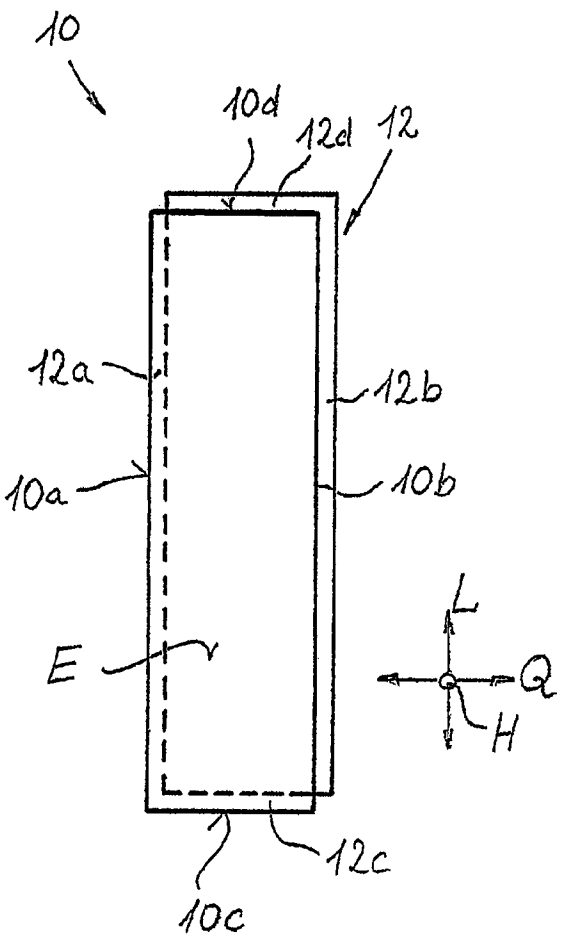
FIG. 1 A top view of a cladding panel according to the invention.

In FIG. 1, a panel according to the invention is designated in general as 10. The panel 10 is embodied as a rectangular panel and has two long sides 10*a* and 10*b* and two short sides 10*c* and 10*d* arranged respectively in pairs opposite one another. In the exemplary embodiment shown, the panel 10 is provided with a coupling mechanism both on the long sides 10*a* and 10*b* and on the short sides 10*c* and 10*d*, wherein the coupling mechanism serves to connect the panel 10 to adjacent panels 10', 10", etc., in the longitudinal direction L or in the transverse direction Q (see FIG. 2).

The coupling mechanism 12 is composed essentially in the form of a groove 12*a* provided on the long side 10*a* and a tongue 12*b* provided on the long side 10*b*, which together form the coupling mechanism on the long side. Additionally, the coupling mechanism is composed of a groove 12*c* provided on the short side 10*c* and a tongue 12*d* provided on the short side 10*d*, which together form the coupling mechanism on the short side. These coupling mechanisms 12 can be embodied in different variants, some of which will be explained below in more detail with reference to FIGS. 3 through 6. However, all of these coupling mechanisms have the common property that pairs of grooves and tongues 12*a*/12*b*, 12*c*/12*d* assigned to one another are embodied such that the pairs interlock in the manner of jigsaw puzzle pieces when two identical panels 10 are in a connected state, thus prestressing is avoided. In particular the lower groove boundary lip is not permanently deflected out of its rest position, when the panels are in a connected state.

Figure 3:
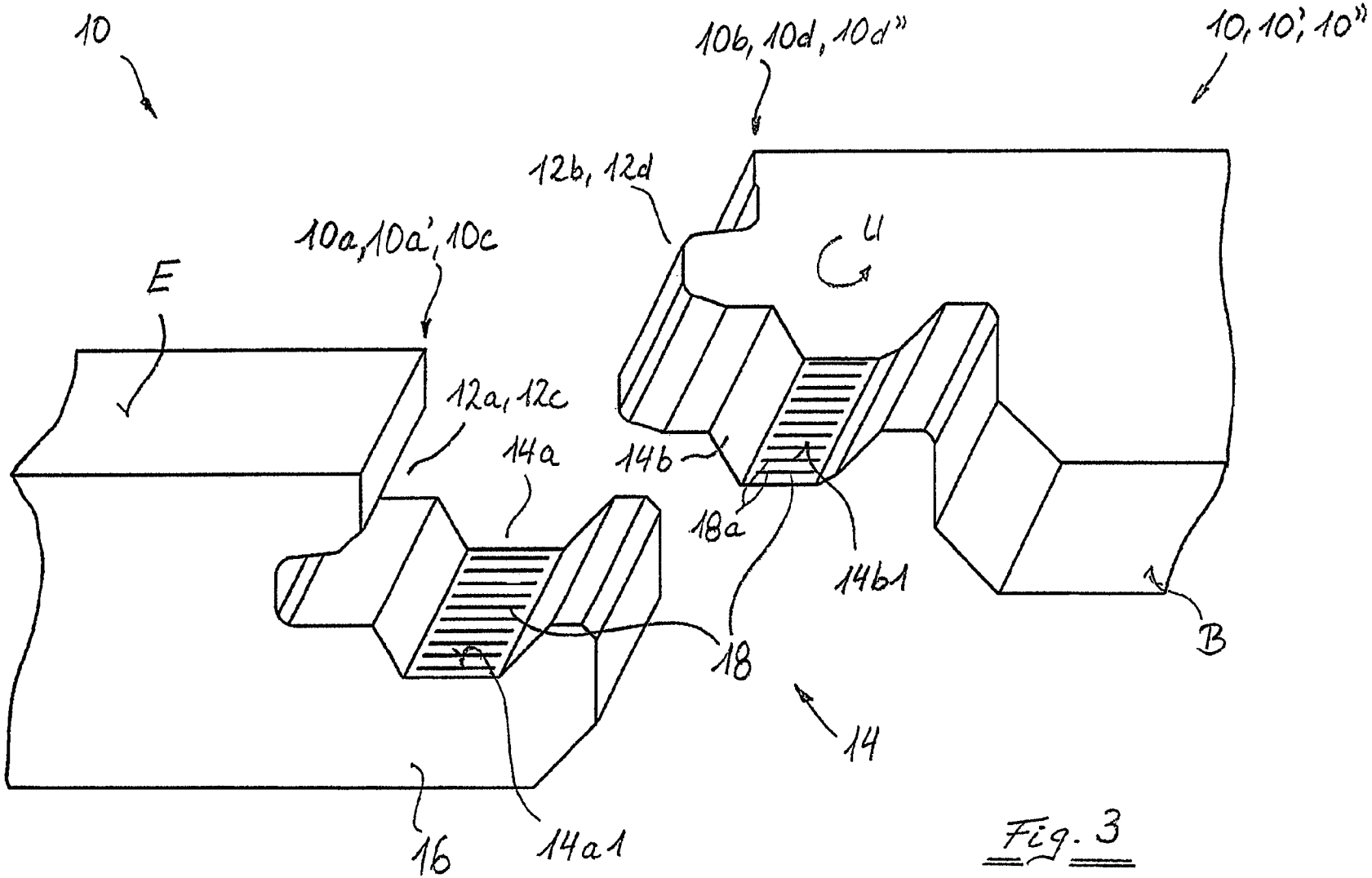
FIG. 3 A perspective view of the end of the groove and the end of the tongue of a cladding panel provided with a roughening according to the invention.

The representation according to FIG. 3 can be understood as showing the groove edge 10*a* or 10*c* in the bottom left in a first perspective view, while a second perspective view can be understood as showing the tongue edge 10*b* or 10*d* of the same panel 10 in the top right. However, since the panels that are joined to form a covering layer are embodied to be identical, the representation can also be understood as showing the edges 10*b*, 10*a*' or 10*c*, 10*d*" of two panels 10, 10' or 10, 10" embodied to identically adjoin one another (see FIG. 2).

The embodiment represented in FIG. 3 is a groove/tongue profile which can be connected by angling two adjacent panels 10 and 10' or 10" into one another. Therefore, the left groove panel 10 in FIG. 3 can lie flat on the floor, whereas the right tongue panel 10' or 10" in FIG. 3 is supplied from the side in a position angled with respect to the horizontal, until its tongue 12*b*, 12*d* engages with the groove 12*a*, 12*c* of the panel 10. Subsequently, the locking mechanism 14 provided at the coupling mechanism 12*a*, 12*c* or 12*b*, 12*d* of the two panels 10 and 10' or 10" can be brought into engagement with one another by pivoting the tongue panel 10', 10" downward. In the exemplary embodiment shown, the locking mechanism 14 is thereby formed on the groove side 12*a*, 12*c* of the panels by a recess 14*a* embodied in the upper surface of the lower lip 16, which delimits the groove 12*a*, 12*c*. On the tongue side of the panel 10, the locking mechanism 14 is formed by a projection 14*b* provided on the underside of the tongue 12*b*, 12*d*.

When the two panels 10 are connected, the engagement of the coupling mechanism 12 prevents the relative movement of the two panels 10 in the upward direction H (see FIG. 1), i.e., in a direction running orthogonally to the panel plane or walking surface E of the panels 10. Moreover, the interaction of the locking mechanism 14 prevents the relative movement of the two panels 10 in a direction running in the panel plane E and orthogonally to the respective side edge 12*a* through 12*d*. The panel plane E is thereby spanned by the longitudinal direction L (direction of the long sides 10*a* and 10*b*) and the transverse direction Q (direction of the short sides 10*c* and 10*d*) of the panels 10.

In contrast to the panels of the prior art, the panels 10 according to the invention also have a roughening 18 which at least impedes a relative movement of two panels 10 connected to one another in the longitudinal direction of the respective side edge 10*a*/10*b*, 10*c*/10*d*. To this end, at least one surface section of the surfaces bearing against one another of the coupling mechanism 12 and the locking mechanism 14 is provided with a roughening 18 of this type. In the exemplary embodiment represented in FIG. 3, the roughening 19 can be formed on the base area 14*a*1 of the recess 14*a* on the groove panel shown on the left in FIG. 3, and on the top area 14*b*1 of the projection 14*b* of the tongue panel shown on the right in FIG. 3. Please note that the two surfaces 14*a*1 and 14*b*1 mentioned above bear against one another when the two adjacent panels are in a connected state, and that their respective roughenings is interact with one another, which effectively increases the friction in the longitudinal direction of the respective side edges 10*a*/10*b*, 10*c*/10*d*. Accordingly, the surfaces 14*a*1 and 14*b*1 of the panel 10 form "complementary" surfaces within the meaning of the present application.

In the longitudinal direction of the two side edges, the roughenings 18 extend preferably over the entire length of the edges, whereas they are merely provided on part of the boundary surfaces of the groove or the tongue in the circumferential direction U, as shown in FIG. 3. The latter, however, is mainly due to reasons of production technology.

As indicated diagrammatically in FIG. 3, the roughenings 18 are respectively formed by a toothing, including the teeth 18*a* that follow one another in the longitudinal direction of the respective side edge 10*a*/10*b*, 10*c*/10*d* ("tooth sequence direction"). Each individual tooth extends essentially in the circumferential direction U, i.e., orthogonally to the longitudinal direction of the respective side edge ("tooth extension direction").

Figure 4:
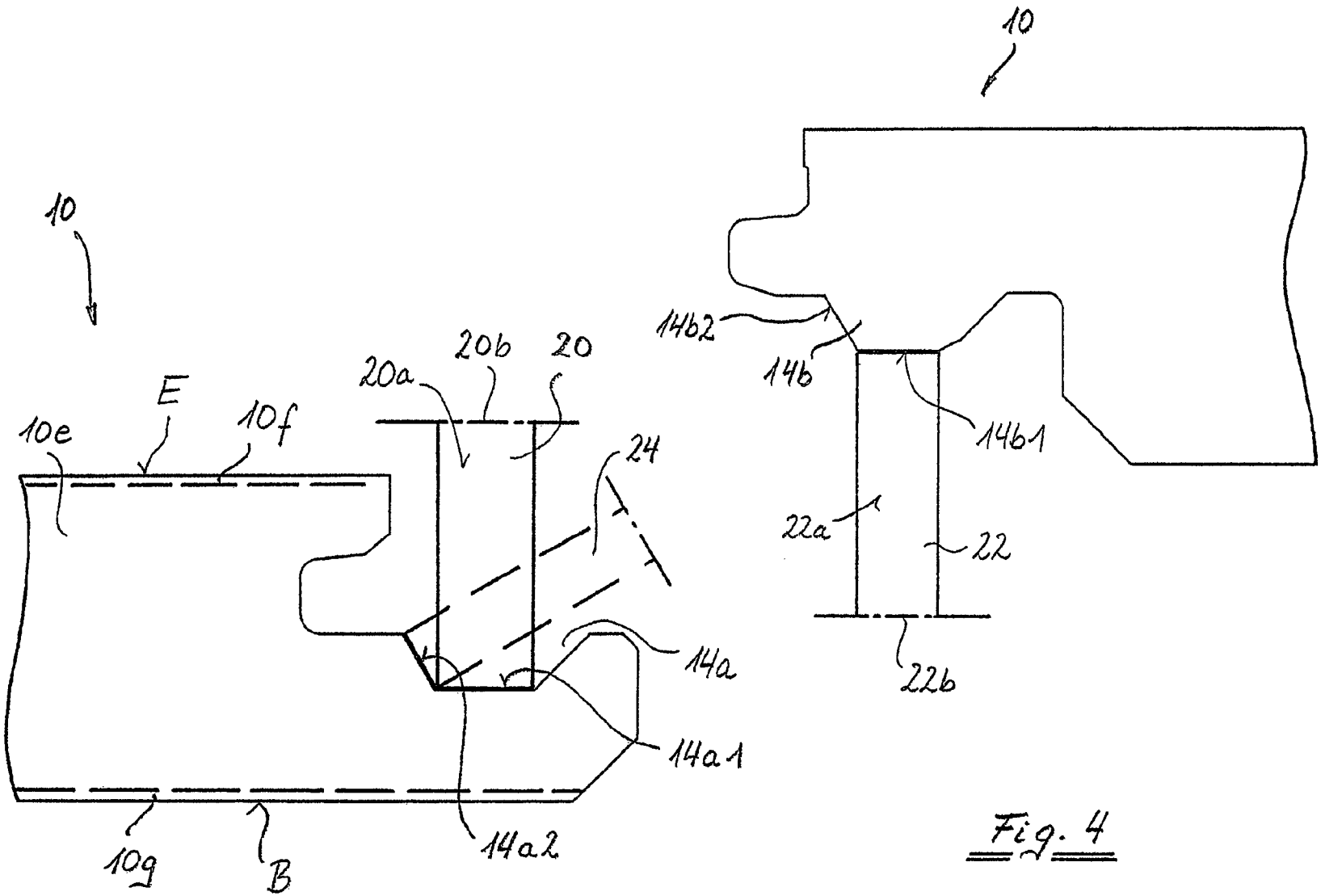
FIG. 4 A diagrammatic side view of the panel according to FIG. 3 to explain the method of embodying the roughening.

As shown diagrammatically in FIG. 4, the toothing can be embodied, e.g., by pressing the teeth 18*a* into the base area 14*a*1 of the recess 14*a* or into the top area 14*b*1 of the projection 14*b* with a rotating tool 20 or 22. To this end, rotating tool 20 or 22, which is brought into engagement with the surfaces 14*a*1 or 14*b*1, includes a circumferential surface 20*a* or 22*a* having a counter-toothing corresponding to the toothing to be formed as a roughening 18. Attention must further be paid to the fact that the tool 20 or 22 rotates synchronously to the movement of the panel 10, i.e., with a rotation about the axis 20*b* or 22*b*, the circumferential speed corresponds to the feed rate of the panel 10 in the direction of the respective side edge 10*a* through 10*d*.

In addition, FIG. 4 shows another tool 24 which corresponds to the tools 20 and 22 in terms of structure and function, but is arranged such that it provides a toothing to an oblique boundary surface 14*a*2 of the recess 14*a*. It is noted that no analogous toothing tool is provided for the oblique surface 14*b*2 of the tongue panel is shown on the right in FIG. 4. However, even the one-sided provision of a toothing can further increase the friction between the two panels.

Figure 5:
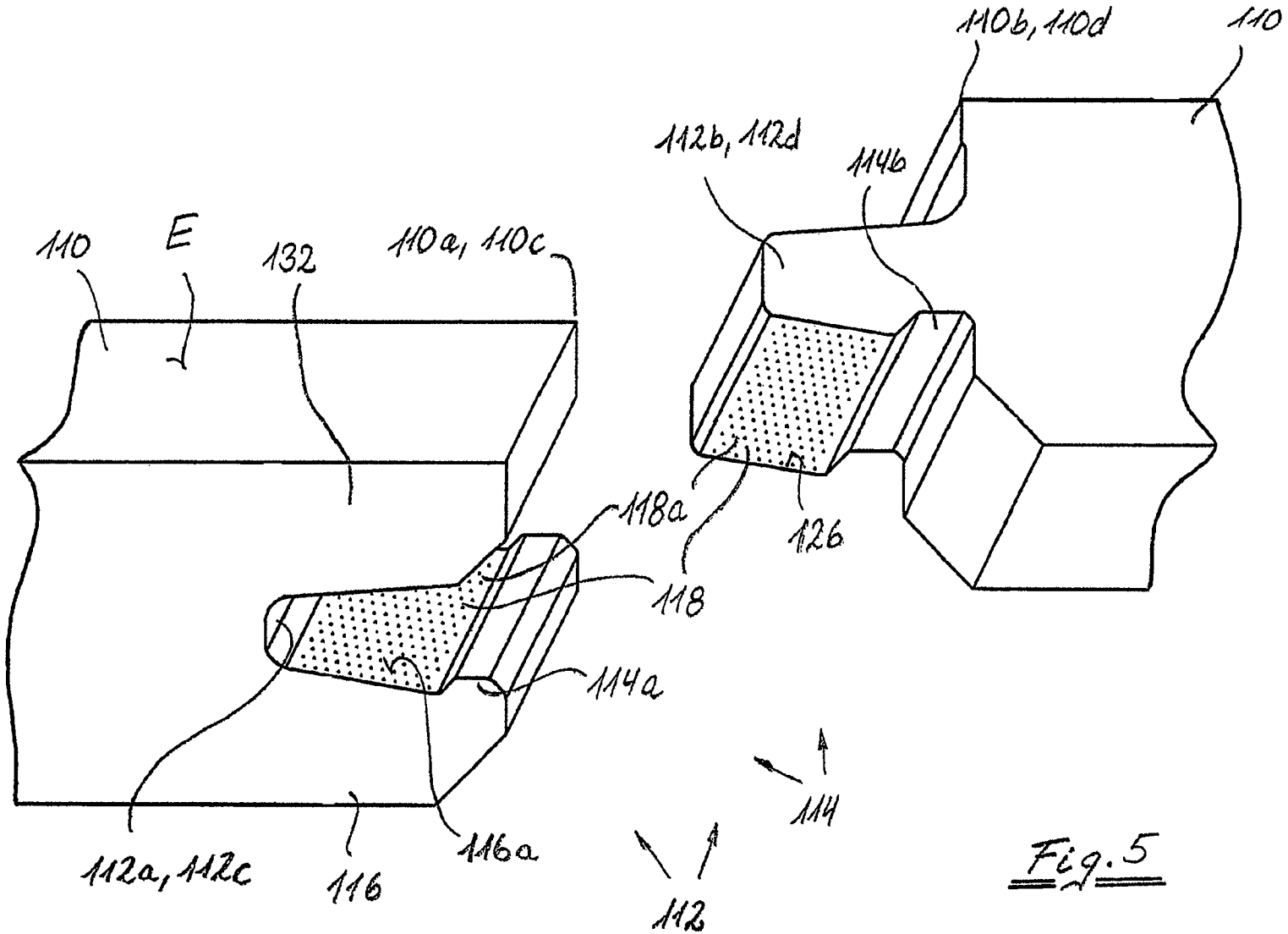
FIGS. 5 and 6 Views similar to FIGS. 3 and 4 of a further embodiment of a cladding panel according to the invention.
Figure 6:
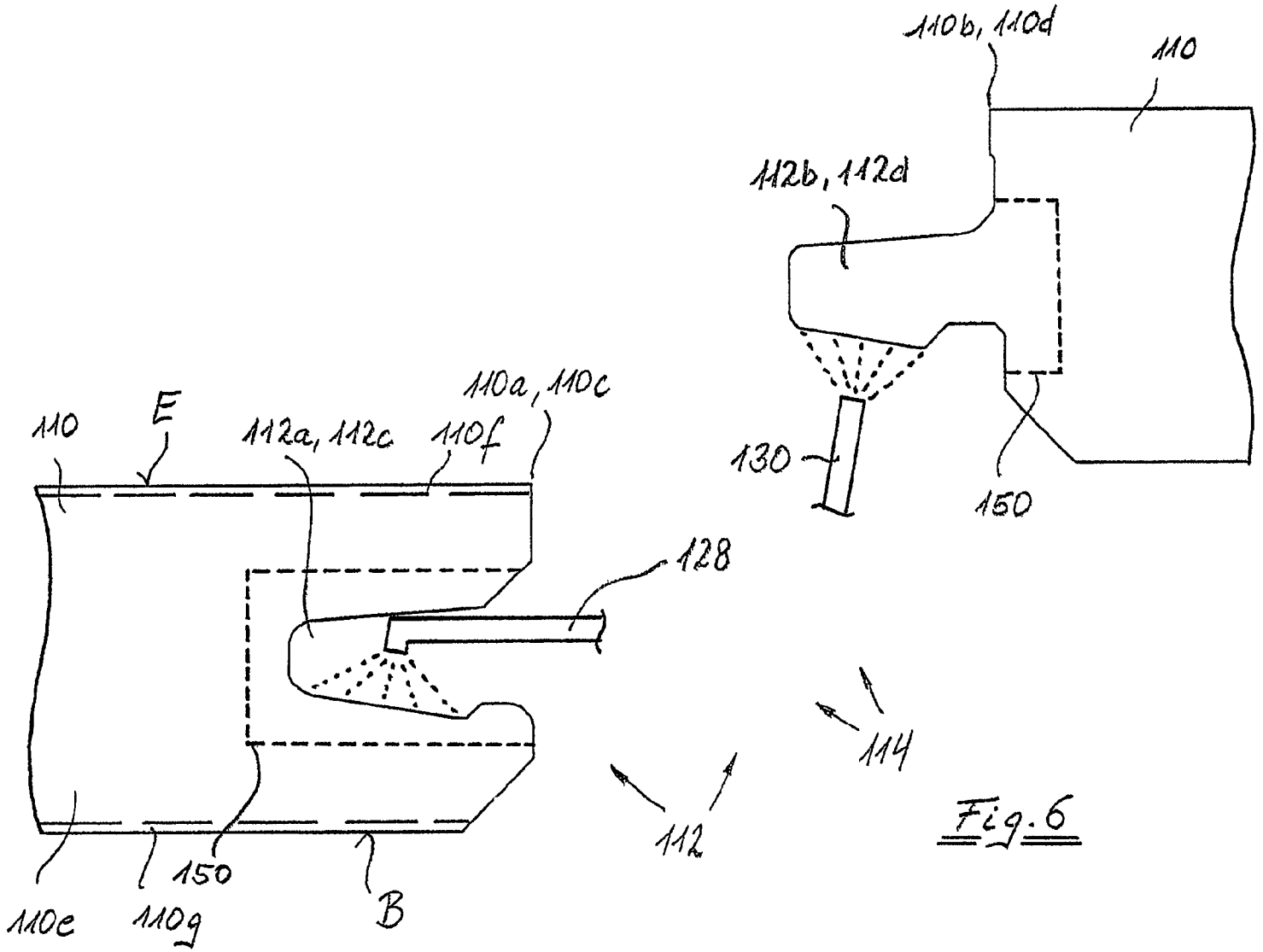

FIGS. 5 and 6 show a modified embodiment that corresponds essentially to the embodiment according to FIGS. 3 and 4. In FIGS. 5 and 6, analogous parts are thus provided with the same reference numbers as in FIGS. 3 and 4, but increased by the number 100. FIGS. 5 and 6 will be described below only as far as they differ from the embodiment previously explained. Explicit reference is hereby made otherwise.

The panel 110 represented in FIGS. 5 and 6 differs from the panel 10 represented in FIGS. 3 and 4 in that the coupling mechanism 112 embodied at the side edges 110*a*-110*d* is now embodied as being moved towards one another in an essentially planar manner parallel to the panel plane E. In this case, the locking mechanism 114 is formed by a projection 114*a* at the free end of the lower lip 116 delimiting the groove 112*a*, 112*c*, and by a recess 114*b* in the transition area of the tongue 112*b*, 112*d* into the panel 110. When the tongue 112*b*, 112*d* is inserted into the groove 112*a*, 112*c*, the lower lip 116 is deflected, i.e., bent downward, until the nose 114*a* can catch in the recess 114*b*. As a result of this catching, the lower lip 116 returns again to its resting position shown in FIG. 5, in which it is free of any mechanical deformation.

Also in the exemplary embodiment shown in FIGS. 5 and 6, both the groove 112*a*, 112*c* and the tongue 112*b*, 112*d* are provided with a roughening 118, which may be on the upper boundary surface 116*a* of the lower lip 116 and on the lower boundary surface 122 of the tongue 112*b*, 112*d*. In the present case, the roughenings 118 are formed by particles 118*a* that can be applied by way of a spraying tool 128 or 130 (see FIG. 6) to the surfaces 116*a* and 126, preferably using an adhesion promoter which, after having dried, keeps the particles 118*a* on the surfaces 116*a*, 126.

It is also conceivable to provide only one of the two complementary surfaces 116*a*, 126 with sprayed-on particles of this type to achieve a higher friction between the two panels 110. Furthermore, it is also conceivable to apply particles of this type to the surfaces not visible in FIG. 5 on the lower side of the upper groove boundary lip 132 and on the upper side of the tongue 112*b*, 112*d*.

Another embodiment for the roughening according to the invention is explained below based on the diagrammatical representations according to FIGS. 5 and 6:

Additionally, a solvent can be applied to the surfaces 116*a* and 126 by way of the spraying tools 128 and 130, wherein the solvent starts to dissolve a wood material, e.g., solid wood, MDF, or the like, used to form the panels 110 to such an extent that individual wood fibers disengage at least in part from the material compound and project out of the surface when the treatment agent has dried. In this case, roughening 118*a* designates the wood fibers projecting from the surfaces 116*a* and 126*a* in FIG. 5.

The panels 10, 110 can be made of any material, e.g., a wood material such as: solid-wood boards, MDF boards, chipboards, or the like. The panels 10, 110 can also be made of compact laminate, plastic, and suitable panel materials of this type.

If the panels are to be used as flooring panels, they can have a core 10*e*, 110*e*, as indicated in FIGS. 4 and 6. The panel 10,

110, shown in the bottom left, may comprise a core embodied, e.g., as an MDF board (medium-density fiberboard), whereby a decorative layer 10*f*, 110*f* is glued to the core 10*e*, 110*e* on the panel's walking surface E, and a leveling layer 10*g*, 110*g* is glued to the panel's underside B resting on the floor, opposite the walking side E. The decorative layer 10*f*, 110*f* can comprise, e.g., one or more plies of printed paper, which is or are saturated with synthetic resin. In an analogous manner, the leveling layer 10*g*, 100*g* can be formed by a laminate layer comprising several paper plies of this type.

The groove 112*a*, 112*c* or the tongue 112*b*, 112*d* do not necessarily have to be formed directly of the material of the core 110*e*. Rather, as indicated by a dashed line in FIG. 6, it is also possible to inject a suitable material, e.g., plastic, a wood extrudate, or the like, into a recess 150 prepared in the side surface 110*a* through 110*d* and let it cure there. It is also possible to embody the groove 112*a*, 112*c* or the tongue 112*b*, 112*d* subsequently by machining.

The invention claimed is:

1. A cladding panel comprising:

at least two pairs of side edges lying substantially opposite one another;

a coupling mechanism structured and arranged on at least one of the at least two pairs of side edges, and comprising a groove and a tongue extending along respective side edges of the at least one pair; and a roughening formed on at least a section of the tongue and on at least a section of the groove, wherein the roughening comprises a toothing extending in a tooth sequence running direction that is essentially in the longitudinal direction of the respective side edge and in a tooth extension direction that is essentially in a circumferential direction of the groove and the tongue such that a longitudinal axis of each individual tooth extends essentially in the circumferential direction, whereby the at least one roughening section of the tongue and the at least one roughening section of the groove are arranged to form complementary sections that bear against one another when the cladding panel is connected to at least one other cladding panel, wherein the roughening formed on the at least one section of the tongue is formed on a protrusion, and wherein the roughening formed on the at least one section of the groove is formed on a corresponding recess, wherein the roughening increases friction between the groove of a first panel and the tongue of a second panel.

2. The cladding panel of claim 1, wherein the at least one other cladding panel is identical to the cladding panel.

3. The cladding panel of claim 1, wherein the toothing is formed by an essentially chipless machining.

4. The cladding panel of claim 3, wherein the essentially chipless machining forms at least one of indenting or serrating.

5. The cladding panel of claim 1, wherein the toothing is formed by a chip-forming machining.

6. The cladding panel of claim 5, wherein the chip-forming machining at least one of pierces or mills the at least one section.

7. The cladding panel of claim 1, wherein the roughening is in the form of a plurality of wood fibers.

8. The cladding panel of claim 7, wherein the plurality of wood fibers are released at least in part from a material compound of the cladding panel, whereby the material compound is structured to protrude from the at least a section of the at least one tongue and the groove.

9. The cladding panel of claim 1, wherein the cladding panel is a rectangular cladding panel comprising a short side and a long side, at least the long side including the roughening on the at least a section of at least one of the tongue and the groove.

10. The cladding panel of claim 1, wherein the at least one section extends over at least one of a part of the length of a surface of the tongue and a part of a length of a surface of the groove.

11. The cladding panel of claim 1, wherein the at least one section extends essentially over at least one of an entire length of a surface of the tongue and an entire length of a surface of the groove.

12. The cladding panel of claim 1, wherein the at least one section extends over part of at least one of a circumference of a surface of the tongue and a surface of the groove in the circumferential direction.

13. The cladding panel of claim 1, wherein the at least one section extends essentially over at least one of an entire circumference of at least one of a surface of the tongue and a surface of the groove in the circumferential direction.

14. The cladding panel of claim 1, wherein at least a core of the panel comprises at least one of wood material, compact laminate, and plastic.

15. The cladding panel of claim 14, wherein the wood material comprises at lease one of solid wood, a chipboard, or an MDF board.

16. The cladding panel of claim 1, wherein the coupling mechanism further comprises a locking mechanism extending in a longitudinal direction of the respective side edges of at least one part.

17. The cladding panel of claim 16, wherein the locking mechanism is formed as one piece from a material comprising a core of the panel.

18. The cladding panel of claim 16, wherein at least one of the coupling mechanism and the locking mechanism is embodied in or at a coupling unit, which is connected to a core of a panel.

19. The cladding panel of claim 1, wherein the cladding panel is a flooring panel.

20. A method for forming a cladding panel, comprising:

forming a groove and a tongue at opposite side edges of a panel; and providing a roughening on at least a section of the tongue and at least a section of the groove, wherein the roughening comprises a toothing extending in a tooth sequence running direction that is essentially in the longitudinal direction of the respective side edge and in a tooth extension direction that is essentially in a circumferential direction of the groove and the tongue such that a longitudinal axis of each individual tooth extends essentially in the circumferential direction, whereby the at least one roughening section of the tongue and the at least one roughening section of the groove are arranged to form complementary sections that bear against one another when the cladding panel is connected to at least one other cladding panel, wherein the roughening formed on the at least one section of the tongue is formed on a protrusion, and wherein the roughening formed on the at least one section of the groove is formed on a corresponding recess, wherein the roughening increases friction between the groove of a first panel and the tongue of a second panel.

* * * * *